United States Patent [19]

Luther

[11] Patent Number: 4,920,889

[45] Date of Patent: May 1, 1990

[54] FIN STABILIZED, SUBCALIBER PROPELLING CAGE SOBOT PROJECTILE

[75] Inventor: Hans W. Luther, Kaarst, Fed. Rep. of Germany

[73] Assignee: Rheinmetall GmbH, Düsseldorf, Fed. Rep. of Germany

[21] Appl. No.: 228,350

[22] Filed: Jul. 18, 1988

[30] Foreign Application Priority Data

Jul. 23, 1987 [DE] Fed. Rep. of Germany ..... 3724401

[51] Int. Cl.[5] ..... F42B 13/16

[52] U.S. Cl. ..... 102/521

[58] Field of Search ..... 102/520–523, 102/703

[56] References Cited

U.S. PATENT DOCUMENTS

| | | | |
|---|---|---|---|
| 2,788,744 | 4/1957 | Donner | 102/522 |
| 3,927,618 | 12/1975 | Engel | 102/523 |
| 4,326,464 | 4/1982 | Price | 102/523 |
| 4,372,217 | 2/1983 | Kirkendall et al. | 102/521 |
| 4,608,927 | 9/1986 | Romer et al. . | |
| 4,653,404 | 3/1987 | Halverson . | |
| 4,776,280 | 10/1988 | Burri et al. | 102/522 |

FOREIGN PATENT DOCUMENTS

| | | |
|---|---|---|
| 1703507 | 4/1973 | Fed. Rep. of Germany . |
| 2003261 | 3/1979 | United Kingdom . |

*Primary Examiner*—Harold J. Tudor

*Attorney, Agent, or Firm*—Spencer & Frank

[57] ABSTRACT

A fin stabilized, subcaliber propelling cage sabot projectile including a projectile body having a high length to diameter ratio, i.e., an arrow projectile, and a discardable propelling cage sabot composed of a plurality of segments which coaxially surround a portion of the length of the projectile body and define an annular air pockect in the front surface of the sabot.

To improve the process of releasing the propelling cage sabot segments from the projectile body once the projectile has left the gun barrel, a desired break location is provided in the propelling cage segments behind the frontal air pocket. This desired break location leads to separation of the outer front portion of the propelling cage sabot segments from the remainder of the sabot segments and thus, in the final effect, to an increase in hit accuracy.

11 Claims, 3 Drawing Sheets

FIG. 5
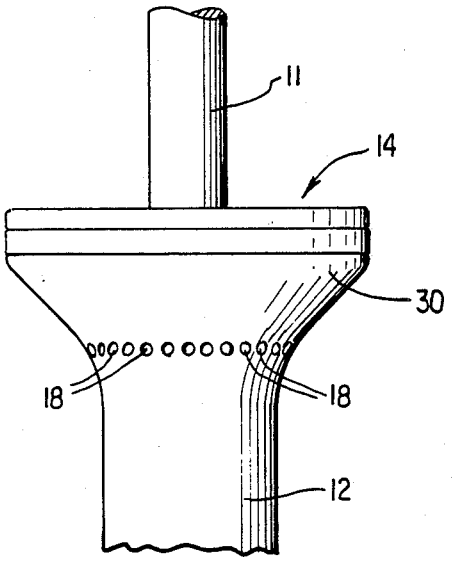
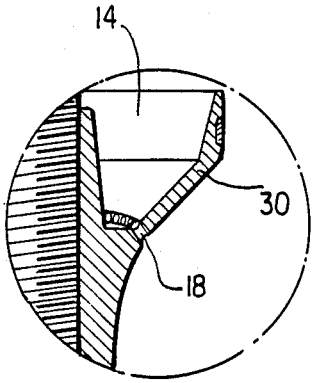
FIG. 6
FIG. 7
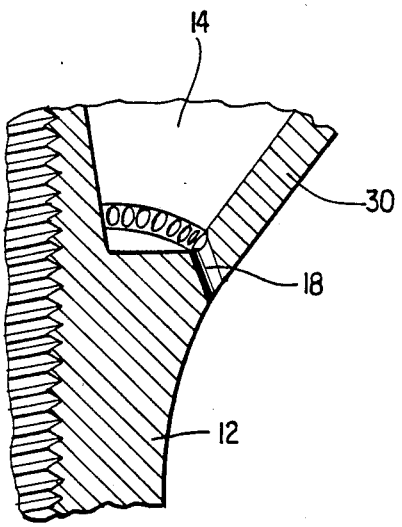

FIN STABILIZED, SUBCALIBER PROPELLING CAGE SOBOT PROJECTILE

BACKGROUND OF THE INVENTION

The present invention relates to a fin stabilized subcaliber propelling cage sabot projectile of the type having a propelling cage sabot which is composed of a plurality of segments which coaxially surround the projectile over only a part of its length and which is provided with an air pocket in its front surface to facilitate separation of the sabot from the projectile after firing.

A projectile of the above type is disclosed in German Patent No. 1,703,507. In such a projectile, the propelling cage sabot serves to transfer the gas pressure to the projectile in the gun barrel, and is discarded as soon as the projectile has left the gun barrel. To facilitate separation, it is known to produce the propelling cage sabot of several, preferably three, segments which coaxially surround the projectile at least over part of its length.

In the endeavor to further improve the final ballistic performance of such projectiles, the realized length to diameter ratio has continued to increase. This also increases the length of the propelling cage sabot since, in the gun barrel this propelling cage sabot still acts as a protection for the comparatively thin projectile against breakage under the extreme stresses exerted, e.g. during transport, loading, unloading.

Since, however, the propelling cage sabot constitutes a dead load percentage, it is desirable to reduce its weight to the greatest possible extent. For overly long projectiles this is possible only by reducing the thickness of the material between the radial flanges provided at the head or front and at the rear or tail of the propelling cage sabot. However, this measure results in a surprisingly poor hit performance for which malfunctions in the release behavior of the segments of this type propelling cage sabot are responsible. In particular, it has been observed, that the frontal portion of each sabot segment, particularly in connection with very long propelling cages, is not released uniformly from the projectile and without further influencing the projectile as expected. More specifically, although the frontal portion of each sabot segment does lift off from the outer jacket or circumferential surface of the projectile under the influence of the dynamic pressure of the in flowing air, the frontal portion is bent backward while the rear side of the sabot segment is still in contact with the projectile, and thus impacts on the projectile in a manner which impairs the precision of the projectile trajectory.

SUMMARY OF THE INVENTION

It is an object of the present invention to provide a novel fin stabilized, subcaliber propelling cage sabot projectile having a high length to diameter ratio, i.e., a socalled arrow projectile, in which the release of the sabot segments takes place in a proper manner.

The above object is achieved according to the present invention by a fin stabilized, subcaliber propelling cage sabot projectile including an arrow type projectile body and a propelling cage sabot composed of a plurality of longitudinally extending segments which coaxially surround the projectile body over only part of its longitudinal extent until it is fired, and which have front portions defining an annular air pocket in the front surface of the propelling cage sabot; and wherein means defining a desired break location for the front portion of each of the propelling cage sabot segments in response to air resistance are provided, with the means being disposed at a position behind the air pocket when seen in the direction of the rear of the sabot.

According to features of the invention, the means defining a desired break location may include an annular, circumferential groove which is formed in at least one of the outer and inner jacket surfaces of the front portions of the propelling cage sabot segments, and/or a plurality of bores formed in an annular region of the segments and uniformly distributed over the circumference of the sabot.

The invention will be described in greater detail below with reference to an embodiment thereof which is illustrated in the drawing figures.

BRIEF DESCRIPTION OF THE DRAWINGS

FIG. 5 is a partial side view showing the upper portion of a modified sabot according to the invention wherein the break locations are in the form of bores disposed in an annular region.

FIG. 6 is a partial sectional view showing a modification according to the invention wherein the bores are combined with two annular grooves as shown in FIG. 1.

FIG. 7 is an enlarged partial sectional view showing a modification according to the invention wherein the bores are combined with only one annular groove.

DETAILED DESCRIPTION OF THE PREFERRED EMBODIMENT

Figure 1:
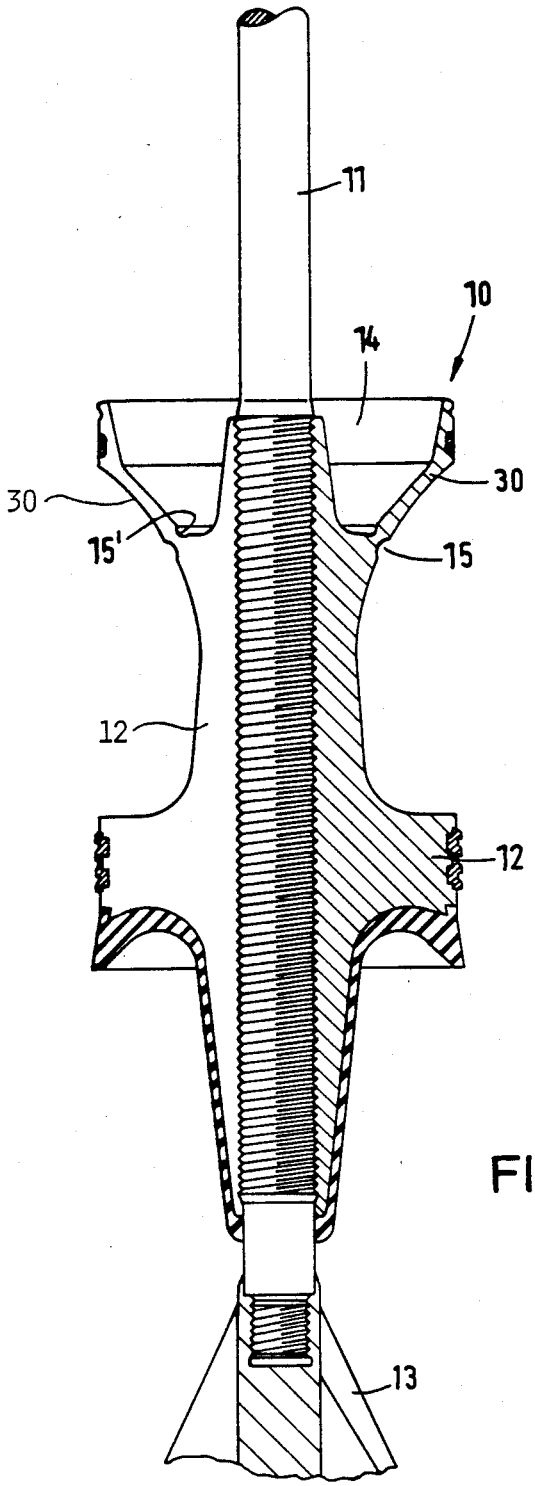
FIG. 1 is a partial sectional view of the significant parts of a fin stabilized propelling cage sabot projectile according to the invention.

Turning now to FIG. 1, there is shown, in part, a fin stabilized subcaliber propelling cage sabot projectile including an arrow type subcaliber projectile body 11 provided with a fin assembly 13 at its rear and a discardable propelling cage sabot 10 which surrounds a portion of the length of the projectile body 11. As is known and discussed above, the propelling cage sabot 10 is utilized during the firing process for the projectile and is released from the projectile body 11 and discarded after the projectile exits from the muzzle of the weapon.

The process of releasing a propelling cage sabot 10 from an arrow type stabilized subcaliber projectile 11 is a very complex process in which numerous forces participate. Aside from the destructive effect of the propelling charge gases on the pressure surface at the tail or rear of the propelling cage sabot 10, which gases ultimately destroy the seal provided there, air resistance is a force which takes a considerable part in the release of the propelling cage sabot and attacks at the frontal surface of the propelling cage sabot. To facilitate release of the propelling cage sabot, the latter is customarily composed of several, for example three, longitudinally extending segments 12 which coaxially surround the projectile body 11 and which must be released from the projectile once the projectile has left the gun barrel without imparting an annoying lateral momentum to the projectile 11. If one of these propelling cage sabot segments 12 comes in contact with the projectile 11 during the release process, a force of several tons is exerted on the projectile which, if it attacks the projectile asymmetrically, obviously will cause the projectile to fishtail or will substantially interfere with its trajectory, and thus adversely influence the precision of the aiming process.

As further shown in FIG. 1, it is customary, for the purpose of obtaining an optimum effect from the forces of the air attacking from the front, to configure the segments 12 of the propelling cage 10 in the front region so that they form an air pocket 14 in the front surface of the sabot 10. This air pocket 14 offers a larger surface of attack to the forces of the air and facilitates the start of the process of releasing the propelling cage sabot segments 12.

Figure 2:
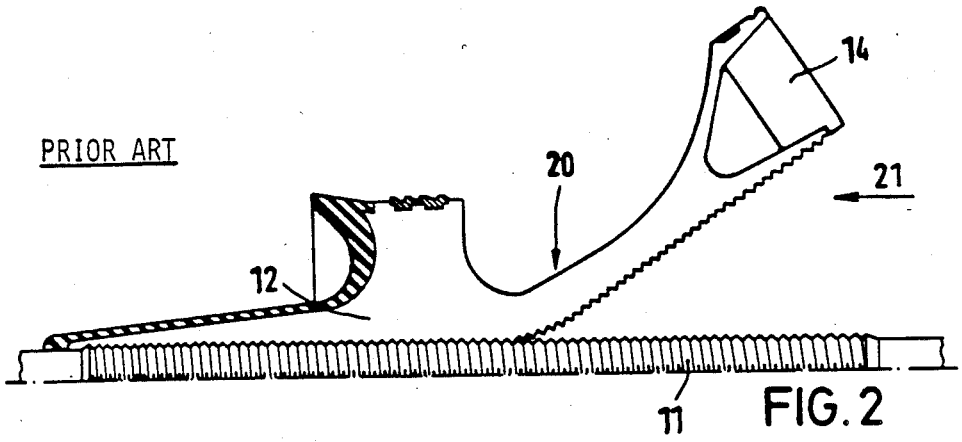
FIG. 2 shows the unfavorable release of a propelling cage sabot segment in a prior art projectile.

However, with particularly thin, elongate propelling cage sabot segments which are used in projectiles having a high length to diameter ratio, i.e., arrow projectiles, the resulting hit record from firing tests has not been satisfactory. This is explained by the fact that the propelling cage sabot segments are not released from the projectile in an optimum manner. Experimental checks of this process indicate that, as shown in FIG. 2, under the influence of air flowing in the direction of arrow 21, the propelling cage sabot segments 12' of the known propelling cage sabots are bent backwards in the manner of a banana peel about a fulcrum disposed approximately in thin region 20 while the rear section of the propelling cage sabot is still in contact with the outer jacket or circumferential surface of the projectile 11. The rear portion of the propelling cage sabot was not released from projectile 11 until later, with, in some cases, propelling cage sabot segment 12' even breaking in region 20. In each case, such an interfered-with release process also involved lateral momentum from the propelling cage sabot segment 12' which was transferred to the projectile 11.

In a completely unexpected manner, it has now been possible to improve this unfavorable release process in that, after initiation of the release process, the air pocket 14, which is in fact required to start the release process, is eliminated shortly after the release process for the propelling cage sabot segments 12 has been initiated. The elimination or removal of the air pocket 14 is effected in that the front portions 30 of the respective propelling cage sabot segments 12, which front portions form or define the air pocket 14, are separated from the remaining portions of the respective propelling cage sabot segments 12.

Figure 3:
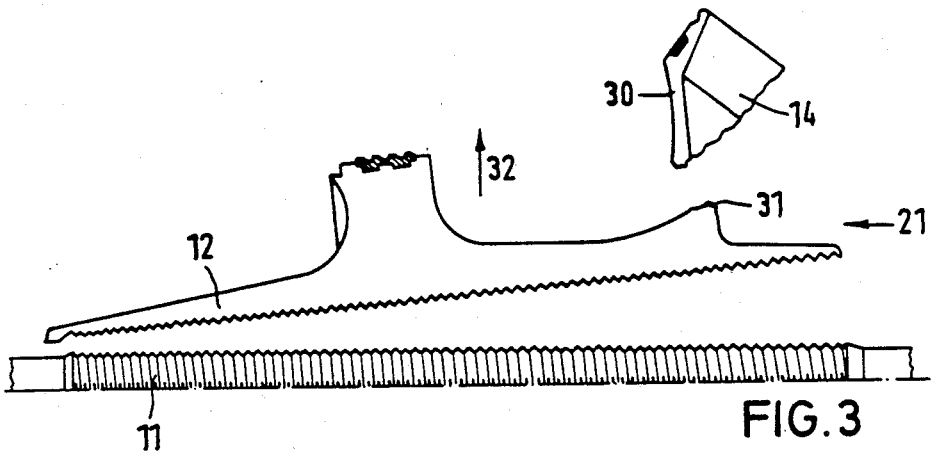
FIG. 3 shows a phase during release of the propelling cage sabot in a projectile configured according to the invention.
Figure 4:
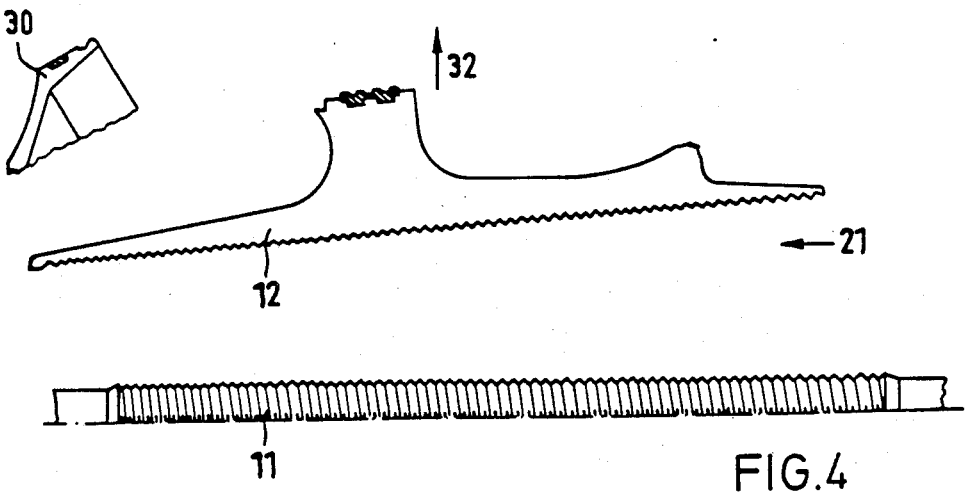
FIG. 4 shows a further phase, which is subsequent to the phase shown in FIG. 3, during release of the propelling cage sabot according to the invention from the projectile body.

This process and the means for achieving same according to the invention will be described with reference to FIGS. 3 and 4. FIG. 4 shows a first phase of the release process of a propelling cage sabot segment 12 configured according to the invention from a propelling cage sabot projectile. Only part of the projectile 11 and of a propelling cage sabot segment 12 are shown. The dynamic pressure of the air attacking from the direction of arrow 21 has already lifted the propelling cage sabot segment 12 partially away from projectile 11 in the direction of arrow 32. This release process was enhanced in that this dynamic pressure is initially effective also in air pocket 14, with, however, this air pocket losing its function once front section 30 of segment 12 has been released from the projectile 11. The proper release of the sabot segments 12 from the projectile 11 is enhanced according to the invention by the fact that the front portion 30 of each segment 12 is provided with a weakened wall portion, for example by means of a surface groove 15 (FIG. 1), to define a desired break location behind the air pocket 14 which, if there is a load on air pocket 14, causes a break to occur in the region 31 (FIG. 3) and thus causes segment portion 30 to be broken off or severed. Since now the breaking away of segment portion 30 drastically reduces the surface area of sabot segment 12 available for attack by the dynamic pressure, the disadvantageous bending of the remaining portion of propelling cage sabot segment 12 described in connection with FIG. 2 and the connected interference with the projectile 11 will no longer occur. Rather, as can be seen in FIG. 4, which shows a further phase of the release process, the propelling cage sabot segments 12 are released from projectile 11 in a very uniform manner and no longer exert an undue momentum on the projectile. As further can be seen in FIG. 4, the separated segment section 30 has moved farther away from propelling cage sabot segment 12 and will drop to the ground soon, as will propelling cage sabot segment 12.

As shown in FIG. 1, the desired break location may advisably be defined as an annular, circumferential groove 15 or 15' provided in either the outer or the inner surface, respectively, of the propelling cage sabot segments 12. Preferably, as shown, two opposing circumferential grooves 15 and 15' in the respective outer and inner surfaces of the propelling cage sabot segments 12 are provided.

According to a further embodiment of the invention, as shown in FIGS. 5–7 the desired break location is formed by bores 18 disposed in an annular zone of the propelling cage sabot segments 12 and uniformly distributed over the circumference. In this connection, it is of course possible to provide an annular, circumferential groove 15 and/or 15' as well as such bores 18 simultaneously as can be seen in FIGS. 6 and 7.

It will be understood that the above description of the present invention is susceptible to various modifications, changes and adaptations, and the same are intended to be comprehended within the meaning and range of equivalents of the appended claims.

What is claimed is:

1. In a fin stabilized, subcaliber propelling cage sabot projectile including an arrow type projectile body and a propelling cage sabot composed of a plurality of longitudinally extending segments which coaxially surround and form-locking engage the projectile body only over part of its longitudinal extent until it is fired, and with front portions of said segments defining an annular air pocket in a front surface of said propelling cage sabot; the improvement comprising means defining a desired break location for said front portion of each of said propelling cage sabot segments in response to air resistance, said means being disposed at a position behind the air pocket when seen in the direction of the rear of the sabot.

2. A propelling cage sabot projectile as defined in claim 1, wherein said means defining a desired break location includes an annular, circumferential groove which is formed in at least one of outer and inner jacket surfaces of said front portions of said propelling cage sabot segments.

3. A propelling cage sabot projectile as defined in claim 2 wherein said annular groove is formed in said outer jacket surface.

4. A propelling cage sabot projectile as defined in claim 2 wherein said annular groove is formed in said inner jacket surface.

5. A propelling cage sabot projectile as defined in claim 2 wherein one said annular groove is formed in each of said inner and outer surfaces with the grooves being opposite one another.

6. A propelling cage sabot projectile as defined in claim 2, wherein said means defining a desired break location further includes a plurality of bores formed in the propelling cage sabot segments in an annular region so as to be uniformly distributed over the circumference of the sabot.

7. A propelling cage sabot projectile as defined in claim 1 wherein said means defining a desired break location includes a plurality of bores formed in the propelling cage sabot segments in an annular region so as to be uniformly distributed over the circumference of the sabot.

8. In a fin stabilized, subcaliber propelling cage sabot projectile including an arrow type projectile having a cylindrical body with a high length to diameter ratio and with a fin assembly attached to rear end of said cylindrical body, and a propelling cage sabot, composed of a plurality of symmetrical mating longitudinally extending segments, which coaxially surrounds and form-lockingly engages said projectile only over part of its cylindrical length, said sabot having a front end surface with a first full-caliber diameter guide flange portion extending from said front end surface, a second full-caliber gas pressure receiving flange portion longitudinally spaced from said first flange portion, a portion of reduced outer diameter between said first and second flange portions, and an annular air pocket formed in said front end surface and defined by an inner jacket surface of said first flange portion; the improvement comprising: means defining a desired break location in each of said segments for at least said first guide flange portion in response to air resistance, said means being disposed at a position substantially corresponding to the bottom of said recess forming said air pocket.

9. A propelling cage sabot projectile as defined in claim 8, wherein said means defining a desired break location includes an annular, circumferential groove which is formed in at least one of an outer jacket surface and said inner jacket surface of said first flange portion of said propelling cage sabot.

10. A propelling cage sabot projectile as defined in claim 9, wherein said means defining a desired break location further includes a plurality of bores formed in the propelling cage sabot segments in said annular groove and uniformly distributed over the circumference of the sabot.

11. A propelling cage sabot projectile as defined in claim 8 wherein said means defining a desired break location includes a plurality of bores formed in the propelling cage sabot segments in an annular region and uniformly distributed over the circumference of the sabot.

* * * * *